United States Patent [19]

Thiers

[11] Patent Number: 4,483,916

[45] Date of Patent: Nov. 20, 1984

[54] IMPROVING THE COLOR BALANCE OF MULTICOLOR PRINTS BY EXPOSURE THROUGH CONTRAST REDUCING LIGHT DISTRIBUTION MEANS

[75] Inventor: Christiaan G. Thiers, Schoten, Belgium

[73] Assignee: Agfa-Gevaert, N.V., Mortsel, Belgium

[21] Appl. No.: 463,287

[22] Filed: Feb. 2, 1983

[30] Foreign Application Priority Data

Feb. 11, 1982 [GB] United Kingdom ..... 8204034

[51] Int. Cl.[3] ..... G03C 5/54; G03C 7/18

[52] U.S. Cl. ..... 430/236; 430/359; 430/383; 430/391; 430/396; 355/35; 355/88

[58] Field of Search ..... 430/236, 359, 383, 391, 430/396, 379; 355/35, 88

[56] References Cited

U.S. PATENT DOCUMENTS 2,252,006 8/1941 Holst et al. ..... 430/140
4,272,186 6/1981 Plummer ..... 355/38

OTHER PUBLICATIONS

"Optical Method for Curve Shape Control", Gilmour, *Research Disclosure* No. 17533, 11/1978, p. 17.
"Contrast Control in Instant Print Film Copies", Meyerhoefer et al., *Research Disclosure* No. 18276, 6/1979, pp. 332 & 333.

*Primary Examiner*—Richard L. Schilling
*Attorney, Agent, or Firm*—A. W. Breiner

[57] ABSTRACT

Method of improving the color balance of a multicolor reversal image obtained in a photographic material itself or obtained by a diffusion transfer reversal process in an image receiving material is provided, wherein said method comprises, as illustrated in FIG. 3, the steps of:

(1) providing a photographic silver halide material (4) capable of yielding in said material or in an image receiving layer a multicolor reversal image of average gradient of at least 1.8;

(2) image-wise exposing said photographic material to or through a multi-color continuous tone original (2) while keeping in the optical path between the original and the photographic material a light-distribution means (3) dividing the light in line-like or dot-like portions over the exposed area of the photographic material, (3) developing and reversal-processing said photographic material, e.g. by dye diffusion transfer-processing, hereby producing a reversal image with average gradient of at most 1.50 and reduced color point spreading.

13 Claims, 12 Drawing Figures

IMPROVING THE COLOR BALANCE OF MULTICOLOR PRINTS BY EXPOSURE THROUGH CONTRAST REDUCING LIGHT DISTRIBUTION MEANS

The present invention relates to a method of improving the colour balance of multicolour prints.

In the usual reproduction of multicolour originals positive images are formed of the subtractive primary colours cyan, magenta and yellow. Such may proceed through a colour negative-positive process or image reversal process based on the use of differently spectrally sensitized silver halide located in superimposed hydrophilic colloid layers. The superposition of silver halide emulsion layers being differently spectrally sensitive to the primary colours blue, green and red and operating respectively with yellow, magenta and cyan dyes or dye precursors is a characteristic of the subtractive system of multicolour image formation.

Each photographic silver halide emulsion has rarely the same speed and exposure latitude so that it is a serious problem to have the colour rendering of each silver halide emulsion layer in balance to arrive at a multicolour print showing no colour shift or stain. Since a colour print is seen in relation to other objects in the field of view, exceedingly small errors in colour balance are perceptible and objectionable. If the multicolour print contains stain or has a high minimum density, it will not reproduce white objects with enough brightness and the print will appear dark and muddy.

A lack of same speed of the different silver halide emulsion layers having their sensitometric curves (log exposure versus density) parallel rather than matching can be adjusted by adapting the blue, green and red light dosage in the printing exposure using the correct colour filtering.

Not correctable, however, by colour filtering are deviations in colour between the lower and higher densities thus when the sensitometric curves are not parallel but crossing. The causes responsable for yielding such non-parallel or crossing sensitometric curves are many, because in each silver halide emulsion layer there can be a different degree of spectral sensitization, hardening, chemical stabilization, different reaction kinetics in the development process etc. Even if everything is in full balance immediately after manufacturing the multicolour material, the aging of the material may have a different influence on each silver halide emulsion layer and consequently on the slope of each independent sensitometric curve so that the problem of keeping the curves matching can not be solved adequately. All this is well known to those skilled in the art.

Commercial silver halide multi-colour materials such as camera negative film, reflection print material (having reflection densities) and print film (having transmission densities) are characterized by log exposure versus density curves represented in FIG. 14–9 and FIG. 14–10 in Neblette's Handbook of Photography and Reprography 7th ed., Van Nostrand Reinhold Company New York (1977) pp. 392–393 from which curves the gamma values can be derived as being 0.57, 2.4 and 3.2 respectively with the last-mentioned curve having an average gradient as defined hereinafter of more than 2.0.

Commercial silver halide multi-colour dye-diffusion transfer materials for instant photography and classical reversal multi-colour materials as described in "Color Foto, 1. Mai 81/11. Jahrg." pp. 106–115 under the heading "Sofortbild-Filme im Vergleich: Sensitometrie und Haltbarkeit" are characterized by log exposure versus density curves having a gamma value not higher than 3.3 and an average gradient as defined hereinafter of about 1.5.

The control of contrast and exposure latitude of commercial photographic materials by exposing through a screened pattern of light-absorbing material, such as developed silver or filter dye, superimposed upon the photographic material is described in Research Disclosure item 17533 of November 1978. The same method applied to contrast control in instant print film copies is disclosed in Research Disclosure item 18276 June 1979. In Example 2 of said Research Disclosure item 17533 it was observed that with the applied photographic colour paper material, exposure and convential processing procedure the colour balance of the print was scarcely affected. In U.S. Pat. No. 4,272,186 of William T. Plummer issued June 9, 1981, a camera and method are descibed for instant colour image recording with reduced contrast using in the exposure step a light distributing means.

It is an object of the present invention to reduce substantially the imperfections in colour balance in multicolour prints of the reversal type.

According to the present invention a method of improving the colour balance of a multicolour reversal image obtained in a photographic material itself or obtained by a diffusion transfer reversal process in an image receiving material is provided, comprising the steps of:

(1) providing a photographic silver halide material capable of yielding in said material or in an image receiving layer a multicolour reversal image, (2) image-wise exposing said photographic material to or through a multi-colour continuous tone original while keeping in the optical path between the light source and the photographic material (preferably between the original and the photographic material) a light-distribution means dividing the light in line-like or dot-like portions over the exposed area of the photographic material, (3) developing and reversal-processing said photographic material e.g. by dye-diffusion transfer-processing characterized in that the said material and said developing and processing are such that if the above image-wise exposure were to have been effected without said light-distribution means using a sensitometric grey wedge as original a reversal wedge print would be produced having blue filter (Wratten filter Blue No. 47), red filter (Wratten filter Red No. 25) and green filter (Wratten filter Green No. 58) sensitometric curves (optical density versus log exposure curves) having a maximum density of at least 1.4 and an average gradient of at least 1.8, preferably an average gradient in the range of 2.0 to 3.5, said average gradient being the slope of the straight line joining the density point 0.2 above fog and the density point 0.2 below maximum density on the said filter sensitometric curves of said wedge print, whereas because the image-wise exposure was effected through said light-distribution means as specified in step (2), blue filter, red filter and green filter sensitometric curves as defined above, are obtained, the average gradients of which are at most 1.50 but not lower than 1.00. The values of the average gradients obtained are preferably 1 to 1.2 and most preferably about 1.10.

By "reversal image" is meant here an image having the same image-values as present in the original used in the image-wise exposure so that the reversal print is actually a negative-to-negative or positive-to-positive image reproduction.

The present invention is explained by means of the accompanying drawings including FIGS. 1 to 12.

FIGS. 9 to 12 represent chromaticity diagrams having ordinate v and abscissa u values as present in the 1960 CIE (CIE stands for Commission Internationale de l'Eclairage) uniform chromaticity diagram wherein the chromaticity values of "shoulder" and "foot" wedge steps of a grey wedge reproduced by dye diffusion transfer reversal on an image receiving material are marked and the influence of the absence of a screen and the use of different screens as light-distributing means in the exposure on the grouping of these values is shown.

Figure 1:
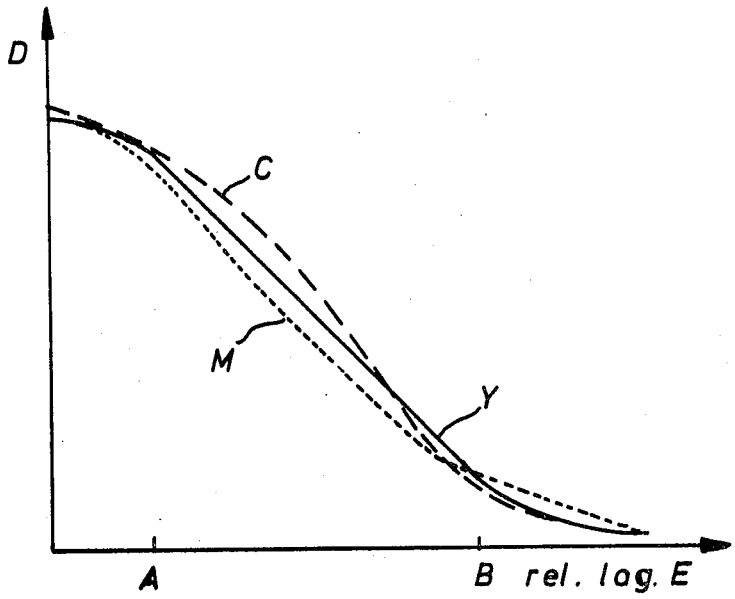
FIG. 1 represents a set of sensitometric curves of three subtractive dye images of a multicolour reversal print.

More particularly in FIG. 1 sensitometric curves corresponding with the yellow, magenta and cyan part images of a multicolour reversal print are represented by the full line Y, the dotted line M and the dashed line C respectively.

FIG. 1 shows a full line sensitometric curve Y [relative log exposure (rel.log E) versus density (D)] having a slope of 45° corresponding therefore with a gamma-value ($\gamma$)1.

The useful exposure range (linear portion) derived from that curve is between the points A and B at the rel.log E axis indicating a rather large exposure range $\Delta$ rel.log E.

Figure 2:
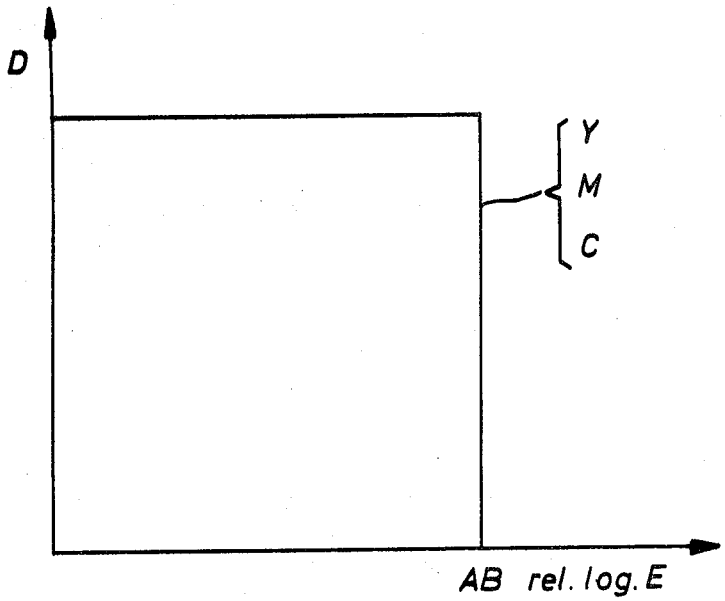
FIG. 2 represents matching $\gamma$-infinity curves of subtractive dye images.

FIG. 2 shows matching sensitometric curves Y, M and C of a multicolour reversal print having a gamma ($\gamma$) value equal to infinity ($\infty$) corresponding with a slope of 90°; maximum density ($D_{max}$) being the same for Y, M and C.

Having regard to the rather high exposure-range sensitometric curves of FIG. 1 one can see how curve-crossing results in a multicolour image having different hue (colour shade) in the higher compared with the lower densities. In the lower densities the magenta dye i.e. the green absorption prevails and in the higher densities the cyan dye i.e. the red absorption dominates.

Operating with a multicolour photographic material characterized by a log exposure-density relationship with gamma-infinity no problems of curve-crossing in the exposure range exist since the exposure range $\Delta$ rel. log E=0. Further a large overexposure does not matter since from a certain exposure dose on, maximum density ($D_{max}$) is reached suddenly, which means that a gamma-infinity reproduction system is a "yes-no" printing system yielding very clean high-lights i.e. whites without stain, which is one of the primary demands for producing a multicolour print with brightness constancy free from colour shade. When using three $\gamma$-infinity yielding silver halide emulsion layers no crossing or deviation of sensitometric curves can occur at all and only a different speed for each of them can be present. Such difference in speed can be corrected easily by a properly dosed light-filtering in the exposure for producing the print. Since in a reproduction system with $\gamma$-infinity one has no exposure latitude (density is built up at full or not) the individual silver halide emulsion layer of the photographic multicolour material have only to be adapted to yield the same maximum density from a certain exposure dose on, so that at the point of maximum density there will be no dominating hue and therefore a correct colour balance is obtained.

The aim of gamma-infinity ($\gamma=\infty$) in colour reversal systems can not be attained in practice but only approximated. In accordance with the present invention reversal colour image reproduction is adapted so that the exposure range is limited analogously to that obtained with negative working "hard" black-and-white line type materials suitable for reproduction of line type originals.

The reduction of the exposure range corresponding with an increase in average gradient and gamma-value can be fairly easily obtained with diffusion transfer image materials containing rapid developable photosensitive silver halide such as silver halide mainly containing silver chloride. With the high average gradient (at least 1.8) elected according to the present invention the individual sensitometric curves are characterized by short toe and shoulder portions and a small exposure range portion that does not allow colour shade to vary over a broad range.

Since a $\gamma$-infinity reproduction system or one that comes close to it is not capable of reproducing a large tone scale (tonal range) and a lot of originals e.g. continuous tone colour transparencies (colour slides) ask for the reproduction of a broad tone scale, the lowering of the contrast in the final print is effected by keeping during exposure in the optical path between the original and the "hard" photographic material a light-distributing means dividing (i.e. screening) the light in line-like or dot-like portions over the exposed area of the photographic material whereby the tone scale of the reproduction i.e. of the print is enlarged.

When using a no-screen exposure the gamma of a print is determined by the gamma of the original, e.g. a continuous grey wedge, and the gamma that follows from the log exposure - density reproduction capabilities of the photographic printing material and its processing. A correct tone rendition of an original asks for a gamma-product of about 1, which means that in a negative-positive printing process the gamma of the negative ($\gamma_n$) and the gamma of the positive ($\gamma_p$) in order to yield a correct tone rendition of the original has to be: $\gamma_n \times \gamma_p = 1$ (Goldberg's rule). By using the screen exposure technique the gamma-product may be represented by $\gamma_n \times \gamma_p \times k = 1$, wherein k is a factor of contrast-lowering smaller than 1 due to the gradation lowering effect of the screening-exposure.

The application of a screening-exposure to remedy for a defective colour balance will only give a final print of acceptable contrast (i.e. of still sufficiently high average gradient) when in the procedure a photographic material is used that offers without screening a fairly "hard" result because otherwise with screen-exposure effective enough to reduce strongly the colour point-spreading too "soft" prints, although colour corrected, will be obtained.

The screening of the image by the light-distributing means may proceed with all kinds of screens.

As light-distribution means basically two types are known from the graphic art field according to the way they are used in that field viz. the type that works in contact with the photosensitive surface and the type that is spaced some distance away from such surface. The former type includes the well-known contact screens and the latter gravure screens and lens screens as described e.g. in the published German patent application (DE-OS) No. 2,445,465 filed Sept. 24, 1974 by Agfa-Gevaert AG. Advantages provided by the lens screen reside in a smaller light-absorption whereby a shorter exposure time and/or light-sources emitting with lower intensity can be used. Lens screens have however, a small screen latitude (see definition furtheron).

Most convenient in handling are the contact screens. The advantages of contact screens over gravure screens (glass screens) are numerous, the major ones being easier and faster use, better resolution, low initial screen cost, and no special equipment for screen distance-adjustment being required, only a vacuum back.

A vacuum back can be dispensed with when a contact screen is used having a transparent rigid support e.g. of glass; the pattern side of the screen being used in contact with the light-sensitive material which in its turn is supported by a rigid flat base e.g. a smooth glass plate.

The influence on tone scale enlargement of the distance from the screen profile or pattern to the photographic material has been discussed in the said DE-OS No. 2,445,465 dealing with a method for the production of colour copies of transparancies (slides).

Control over the final sensitometric results may be achieved by varying the optical density (i.e. opacity) of the opaque or more opaque area, of the screen, the area ratio (i.e. opaque or more opaque area to open or less opaque area), number of lines or dots per mm, shape of the superposed light distributing pattern, and/or the distance between the light-modulating layer of the screen and the light-sensitive layer of the recording material.

Figure 3:
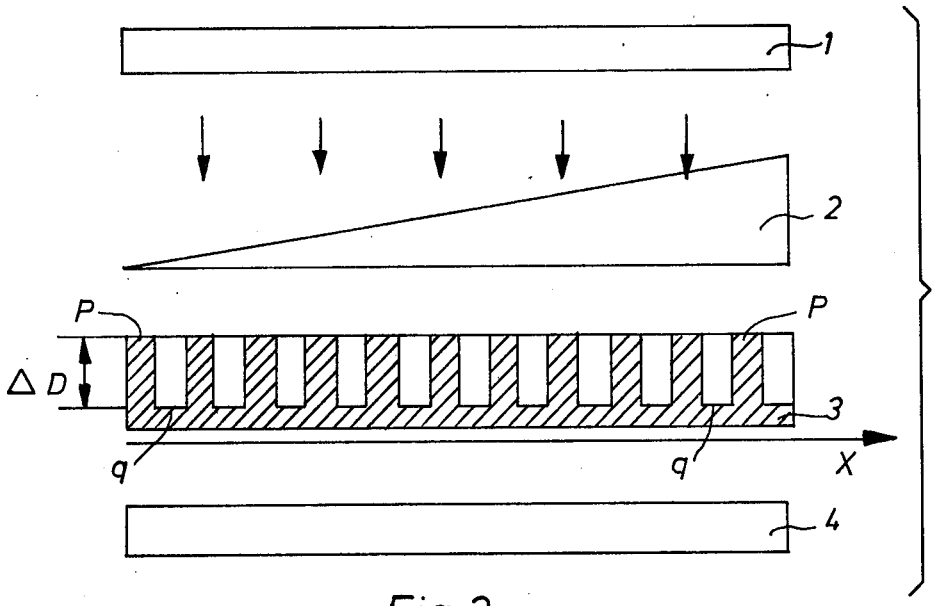
FIG. 3 represents an exposure arrangement including as light-distribution means a square wave modulated screen.

FIG. 3 represents an exposure arrangement wherein a light source 1, a continuous tone grey wedge 2 and a square-wave dot screen 3 (maximum gradient of the dots $=\infty$) are used for printing on a negative type silver halide emulsion layer 4. Screen latitude represented by $\Delta$ D is the density difference between the maximum opacity value and minimum opacity value of the screen which for a dot screen is the density difference between the crests of the dots and valleys between the dots. The points "p" and "q" represent respectively said maximum and minimum values. The screen period is the distance or interval between neighbouring crests or neighbouring valleys and may be e.g. in the range of 190 to 140 $\mu$m, i.e. corresponds to about 50 to about 70 lines per cm.

Figure 4:
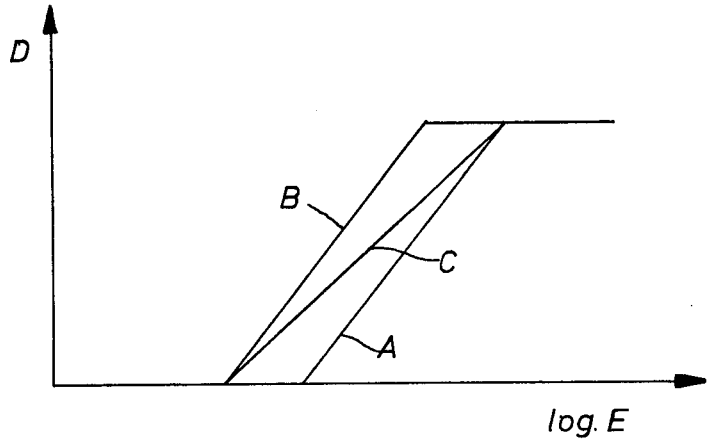
FIG. 4 shows the sensitometric results and more particularly the lowering of average gradient obtained by the exposure according to FIG. 3.

FIG. 4 represents in a log exposure (log E) density (D) diagram a sensitometric curve A which is obtained by linking all the wedge print area corresponding with the points "p", a sensitometric curve B which is obtained by linking all the wedge print area corresponding with the points "q" and the resulting sensitometric curve C which is the visual density reproduction of the screen-printed wedge seen by the eye at a distance where the individual dots are no longer recognizable. Said curve C illustrates very well the contrast lowering action of the use of the screen in the print.

Figure 5:
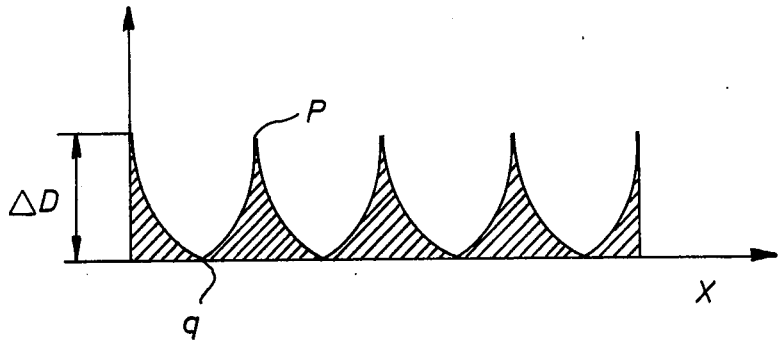
FIGS. 5 to 8 represent particular screen structures and sensitometric curves showing how contrast lowering is obtained therewith.
Figure 6:
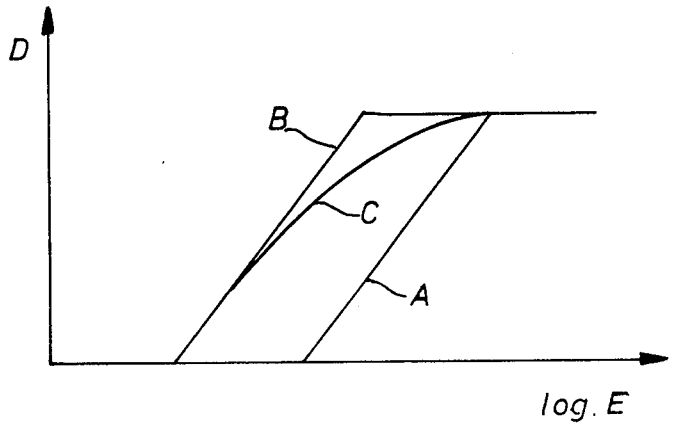

FIG. 5 represents a screen structure with screen dots with very sharp crests and in FIG. 6 the sensitometric results obtained therewith in an exposure arrangement as shown in FIG. 3 are illustrated.

Figure 7:
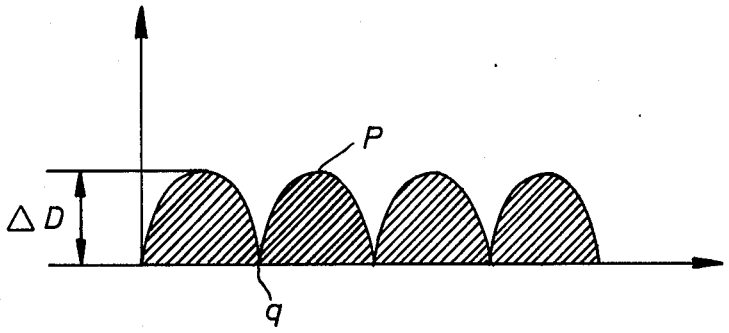
Figure 8:
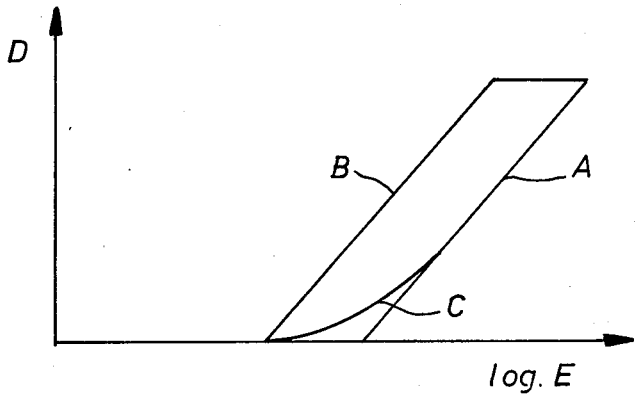

FIG. 7 represents a screen structure with a dot pattern resembling a rectified sinus wave and in FIG. 8 the sensitometric results obtained therewith in an exposure arrangement as shown in FIG. 3 are illustrated. In the FIGS. 6 and 8 the curves A, B and C are obtained as explained for FIG. 4.

In practice for obtaining the largest tone scale increase the screen profile or pattern should be in direct contact with the light-sensitive layers (ref. Research Disclosure November 1978, item 17533). Since direct contact of the screen pattern makes it necessary to apply a camera with a vacuum back much of the simplicity of the system would be lost if such direct contact would be obligatory for the obtaining of a practically useful gradation lowering in the reversal colour reproduction system operating according to the present invention with a sensitometrically "hard" reversal colour copying material.

Therefore rather than striving for a perfect contact, control over the final sensitometric results can be achieved by using a contact screen with its screen profile or pattern spaced from the light-sensitive layers by effecting the exposure with a transparent support layer (thickness 0.01 mm to 0.1 mm) of the screen in contact with the photographic material.

When reproducing an image in the form of an halftone image using a dot screen in the exposure each dot represents a tiny spot incorporating superposed multicolour information which can be analyzed with a colour micro-densitometer yielding the characteristic sensitometric curves for blue, green and red absorption. The human eye integrates the colour information over the whole area of the dot so that in the higher and lower densities of the dot no deviating colour shades are discerned as such.

The use of a screen with high-gradient density profiles (almost square wave profiles) of the lines or dots makes that in the print each dot or line can be reproduced with a gamma close to gamma infinity which is particularly favourable to a more neutral black reproduction. Indeed, in screened reproduction of a black area of the original with high-gradient density profile screens the three secondary colours (yellow, magenta and cyan) are superposed over the whole area of each dot or line at their maximum density resulting in a more neutral black than such would be the case by the use of a low contrast rendering photographic material exposed through a low gradient density profile screen.

For strongly improving the colour balance by the present method preferably contact or gravure screens with high screen latitude i.e. high density difference ($\Delta$D) e.g. at least 1.0, preferably 1.0 to 2.0 are used.

Contact screens with high density difference likewise allow a considerable contrast lowering when the screen pattern or profile is at a distance from the photographic silver halide material. It is a real advantage that therewith no vacuum contact is necessary. Varying contact results in strongly varying light-undercutting of the profiles when they are positioned very close to the photographic material and produces patches of varying image density which patches spoil the image.

According to an embodiment contact screens are used wherein the line or dot profiles are located between a transparent covering sheet and transparent support of a different thickness in the order of 0.01 to 0.1 millimetre. A set of two or three of such screens with different back and front sheet thickness makes it possible to adapt the distance of the screen profiles from the photographic material simply by chosing front or back contact of the screen with the photographic material, which contact need not be perfect i.e. does not need to proceed under vacuum and will suffice for covering the whole range of desired contrast results on printing starting from a group of diverse originals such as e.g. opaque colour reflection prints and colour slides. Desired printing results can follow the Goldberg rule or substantially deviate therefrom for artistic reasons.

Instead of exposing the copying material through a screen placed with its screen pattern or profile in contact or very near e.g. at a distance of 0.1 mm measured from the crests of the screen profile, the light-sensitive layers of the photographic silver halide material may be exposed at a larger distance through a higher frequency screen (i.e. having more lines or dots per mm) placed in contact with the original e.g. transparency to be reproduced, or with the light source, or by illuminating the subject to be copied by means of a multiplicity of discrete, e.g. point-like, light sources that project a sharp, well defined light pattern.

The screen pattern can be uniform and periodic or at random.

The production of multicolour reversal prints by reversal processing using a first black-and-white developer and a second colour developer is described e.g. in Neblette's Handbook of Photography and Reprography 7th ed., Van Nostrand Reinhold Company New York (1977) p. 124.

The production of a reversal multicolour image by image-wise modulated diffusion transfer of dyes or dye providing compounds (dye precursors) from an image-wise exposed and developed photographic silver halide emulsion material into an image-receiving layer can be carried out in a number of ways.

The dye diffusion transfer systems operating with photosensitive silver halide are all based on the same principle, viz. the alteration in the mobility of a dye or dye precursor or of a molecule part being a dye or dye precursor is controlled by the image-wise development of silver halide to silver.

For that purpose ballasted dye-providing chemicals have been developed one type of which is negative working in that they yield negative colour transfer images in combination with a negative working silver halide emulsion and the other type is positive working in that they yield positive colour transfer images in combination with a negative working silver halide emulsion.

According to a first reversal colour imaging system for producing positive colour images by dye diffusion transfer negative working silver halide emulsions containing hydroquinone-dye developers are used which developers including the hydroquinone structure have permanently attached thereto a coloured substituent i.e. either a yellow, magenta or cyan coloured substituent for subtractive multicolour image formation.

In the development of the exposed silver halide the hydroquinone-dye developer is oxidized and thereby transformed into a non-ionizable immobile quinone. Unoxidized hydroquinone-dye is transferred by diffusion to a receptor element. Examples of these dye developers and more details about said system are described in U.S. Pat. No. 2,983,606 of Howard G. Rogers, issued May 9, 1961 and U.S. Pat. No. 3,362,819 of Edwin H. Land, issued Jan. 9, 1968.

In another embodiment of the production of positive colour images a light-sensitive silver halide emulsion layer material with silver halide silver-precipitating layers is used, which layers contain development nuclei for obtaining therein through the silver complex diffusion transfer reversal process (DTR-process) a silver image and oxidized developing agent capable of reacting with a dye releasing compound for image-wise dye release in correspondence with the non-photoexposed area as is described, e.g., in the published European patent application No. 0,003,376 filed Jan. 15, 1979 by Agfa-Gevaert N.V.

According to a second colour diffusion transfer system a positive dye image is produced in an image-receiving layer by a dye which is set free image-wise in diffusible state from a negative working silver halide emulsion material by reaction in alkaline conditions of an initially immobile image-dye providing compound with image-wise remaining non-oxidized developing agent. Examples of such system providing in a receptor element positive diffusion transfer dye images with the aid of an image-wise exposed and developed negative working silver halide emulsion material are described, e.g., in the U.S. Pat. No. 4,139,379 of Richard A. Chasman, Richard P. Dunlap and Jerald C. Hinshaw, issued Feb. 13, 1979 and U.S. Pat. No. 4,139,389 of Hinshaw, J. C. and Henzel, R. P. issued Feb. 13, 1979 and in the published European patent application No. 0,004,399 filed Mar. 9, 1979 by Agfa-Gevaert N.V. and No. 0,038,092 filed Mar. 18, 1981 by Agfa-Gevaert N.V.

According to a third system a diffusible dye is released image-wise by reaction of a particular initially immobile image-dye-providing compound with image-wise oxidized developing agent. Examples of such systems providing on development positive diffusion transfer dye images with an image-wise exposed direct-positive working silver halide emulsion material are described, e.g., in the UK patent specification No. 1,243,048 filed July 23, 1968 by Polaroid Corporation corresponding with the German patent specification No. 1,772,929 filed July 24, 1968 by Polaroid Corporation, in the U.S. Pat. No. 3,227,550 of Keith E. Whitmore and Paul M. Mader issued Jan. 4, 1966 and U.S. Pat. No. 3,628,952 of Walter Puschel, Justus Danhauser, Karlheinz Kabitzke, Paul Marx, Arnfried Melzer, Karl-Wilhelm Schranz, Hans Vetter and Willibald Pelz, issued Dec. 21, 1971, and in the published U.S. Ser. No. B 351,673 of Fleckenstein, L. J. issued Jan. 28, 1975.

A detailed survey of colour diffusion transfer reversal systems for instant photography with single sheet materials (wherein the photographic layers are permanently united with an image-receiving layer or two sheet materials i.e. a separate photographic material and separate image receiving material, is presented in published German patent application (DE-OS) No. 3,107,540 filed Feb. 27, 1981 by Agfa-Gevaert AG and under the heading "Image-transfer processes" by L. J. Fleckenstein in the book "The Theory of the Photographic Process", 4th ed. - Macmillan Publishing Co., Inc. New York (1977) pp. 366–372.

Colour balance improvement obtained by the method of the present invention will be illustrated by means of an Example including comparative tests operating with a multicolour photographic material yielding a multicolour reversal image by dye diffusion transfer according to the principles described in the published European patent application No. 0,004,399 mentioned hereinbefore.

EXAMPLE

Composition of Light-Sensitive Material

A subbed water-resistant paper support consisting of a paper sheet of 110 g/sq.m coated at both sides with a polyethylene stratum of 15 g/sq.m was treated with a corona discharge and thereupon coated in the mentioned order with the following layers, the amounts relating to 1 sq.m of material:

(1) a red-sensitive silver chloride emulsion layer incorporating an amount of silver halide corresponding with 0.5 g of silver, 2 g of gelatin, 0.25 g of ditert-octylhydroquinone and 0.35 g of the cyan quinone compound C of the Table hereinafter;

(2) a magenta filter layer containing 2 g of gelatin, 1 g of Pigment Red 146 (Colour Index No. 11,000) sold under the trade name Colanyl Carmin FBB 31 by Farbwerke Hoechst AG, W.Germany and 0.15 g of octadecylhydroquinonesulphonic acid;

(3) a green-sensitive silver chloride emulsion layer incorporating an amount of silver halide corresponding with 0.5 g of silver, 2 g of gelatin, 0.25 g of ditert-octylhydroquinone and 0.35 g of the magenta quinone compound M of the Table hereinafter;

(4) a yellow filter layer containing 2 g of gelatin, 1 g of Pigment Yellow 83 (Colour Index No. 20,000) sold under the trade name Permanentgelb HR Colanyl Teig by Farbwerke Hoechst AG, W.Germany, 0.15 g of octadecylhydroquinonesulphonic acid and 0.15 g of 1-phenyl-4-methyl-3-pyrazolidinone;

(5) a blue-sensitive silver chloride emulsion layer incorporating an amount of silver halide corresponding with 0.7 g of silver, 2 g of gelatin, 0.5 g of ditert-octylhydroquinone and 0.5 g of the yellow quinone compound Y of the Table hereinafter;

(6) a protective layer containing 1.5 g of gelatin and 0.15 g of 1-phenyl-4-methyl-3-pyrazolidinone.

Exposure A

A sheet A of the obtained photographic material was exposed reflectographically in a REPROMASTER [trade name of OCE HELIOPRINT (Denmark)] type 2001 to a silver achromatic (grey) step wedge of constant 0.1 and through a contacting dot-contact screen $S_1$ with screen latitude $\Delta D=1.0$ and a dot frequency of 60 lines per cm.

Exposure B

A sheet B of the same photographic material as obtained above was exposed as sheet A with the difference however, that screen $S_1$ was replaced by screen $S_2$ with screen latitude $\Delta D=1.7$ and a dot frequency of 60 lines per cm.

Exposure C

A sheet C of the same photographic material as obtained above was exposed as sheet A with the difference however, that screen $S_1$ was left out of the exposure arrangement.

After their exposure the sheets A, B and C were each contacted at 22° C. with a receptor material as described hereinafter which material was pressed against these sheets materials after wetting them in the COPYPROOF CP 38 (trade name) diffusion transfer processing apparatus containing in its tray an aqueous solution comprising per liter: 25 g of sodium hydroxide, 2 g of sodium thiosulphate, 1 g of potassium bromide and 80 g of cyclohexane dimethanol.

After a contact time of 1 minute the receptor materials and light-sensitive materials were peeled apart, washed and dried. In the receptor material a positive multidye wedge image of the original achromatic silver wedge was obtained.

Composition of the Receptor Material

To the same support as described for the above light-sensitive material a coating having the following composition was applied per sq.m:

gelatin: 5 g
triphenyl-n-hexadecylphosphonium bromide: 2 g

Evaluation of the Colour Balance

In the wedge images obtained in the receptor materials A, B and C processed with the light-sensitive materials A, B and C respectively two consecutive steps in the foot of the sensitometric log E versus density curve and two consecutive steps in the shoulder of the same curve were elected. With a General Electric Recording spectrophotometer (diffuse reflectance measurement of a spot of 10 mm×14 mm) the absorption spectrum of these steps was measured in the 400–770 nm wavelength range. The spectral distribution absorption values were used to calculate the corresponding colour points in the CIE 1960 uniform-chromaticity-scale (UCS) diagram in which $u=4X/(X+15Y+3Z)$ and $v=9Y/(X+15Y+3Z)$ and wherein X, Y and Z are the tristimulus values of the colour considered (ref. SPSE Handbook of Photographic Science and Engineering edited by Woodlief Thomas, Jr.—A. Wiley—Interscience Publication John Wiley & Sons—New York (1973) pp. 906–907 and more particularly FIG. 16.4 in said book representing the 1960 CIE uniform chromaticity diagram).

Figure 9:
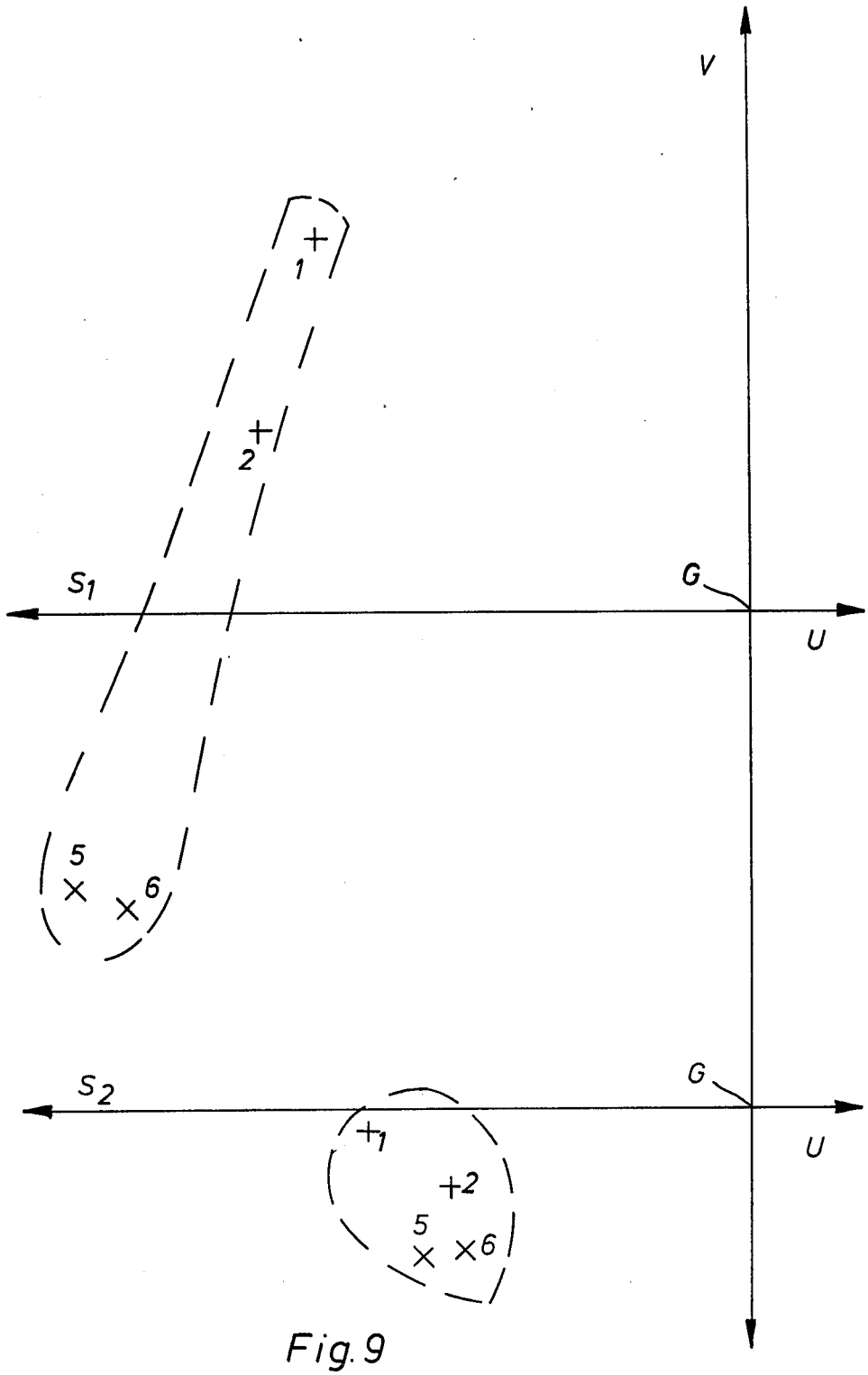
Figure 10:
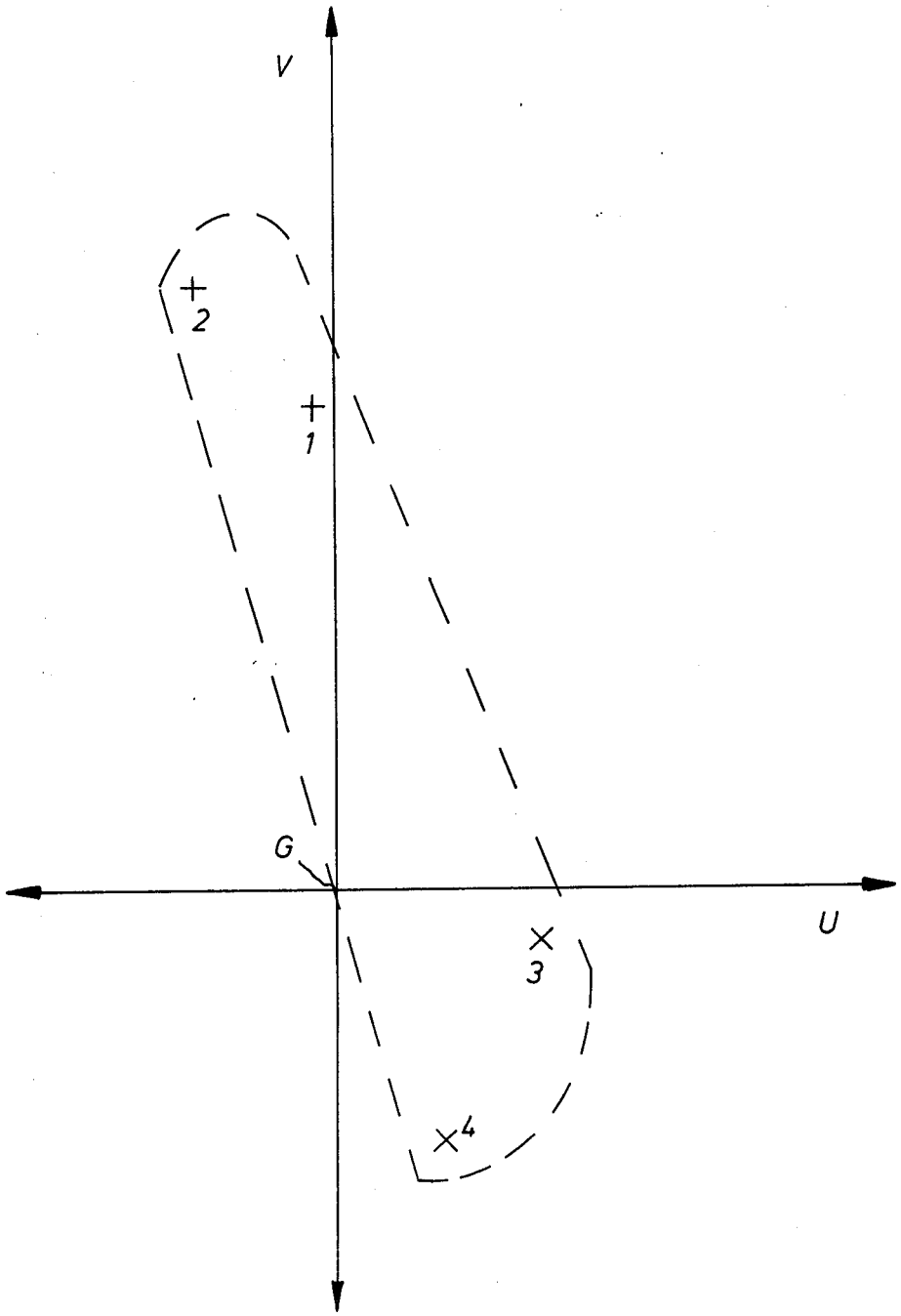

In the accompanying FIGS. 9 ($S_1$, $S_2$) and 10 the location of the colour points (+) of the foot steps 1 and 2 and of the colour points (X) of the shoulder steps 3 and 4 or 5 and 6 of the wedge prints obtained on the materials A, B and C is given respectively. Said location is presented on a same scale in FIG. 9 with respect to the gravity point G of the 1960 CIE uniform chromaticity diagram (triangle) in the u, v-axis system (see FIG. 16.4 mentioned hereinbefore). In FIG. 10 the colour point location is on a 1:2 reduced scale with respect to FIG. 9.

From the FIGS. 9 ($S_1$) and 9 ($S_2$) can be learned that colour point spreading is decreasing with the screen latitude of the applied screen. The colour point spreading resulting from an exposure without screen (FIG. 10) is markedly larger than the spreading obtained with a screen of even moderate exposure latitude.

The average gradient as defined of the photographic prints obtained on image-receiving materials A, B and C was for the sensitometric curves obtained by measurement with MACBETH (trade name) densitometer type RD-lOOR provided with a red filter 2.07; 1.18 and 3.92 respectively. The green filter reading yielded sensitometric curves with average gradient 1.60; 1.00 and 5.10 respectively. The blue filter reading yielded sensitometric curves with average gradient 1.49; 1.00 and 2.8 respectively. The maximum density obtained on these image-receiving materials A, B and C was 1.70, 1.55 and 1.64 respectively for the red, green and blue filter readings.

Figure 11:
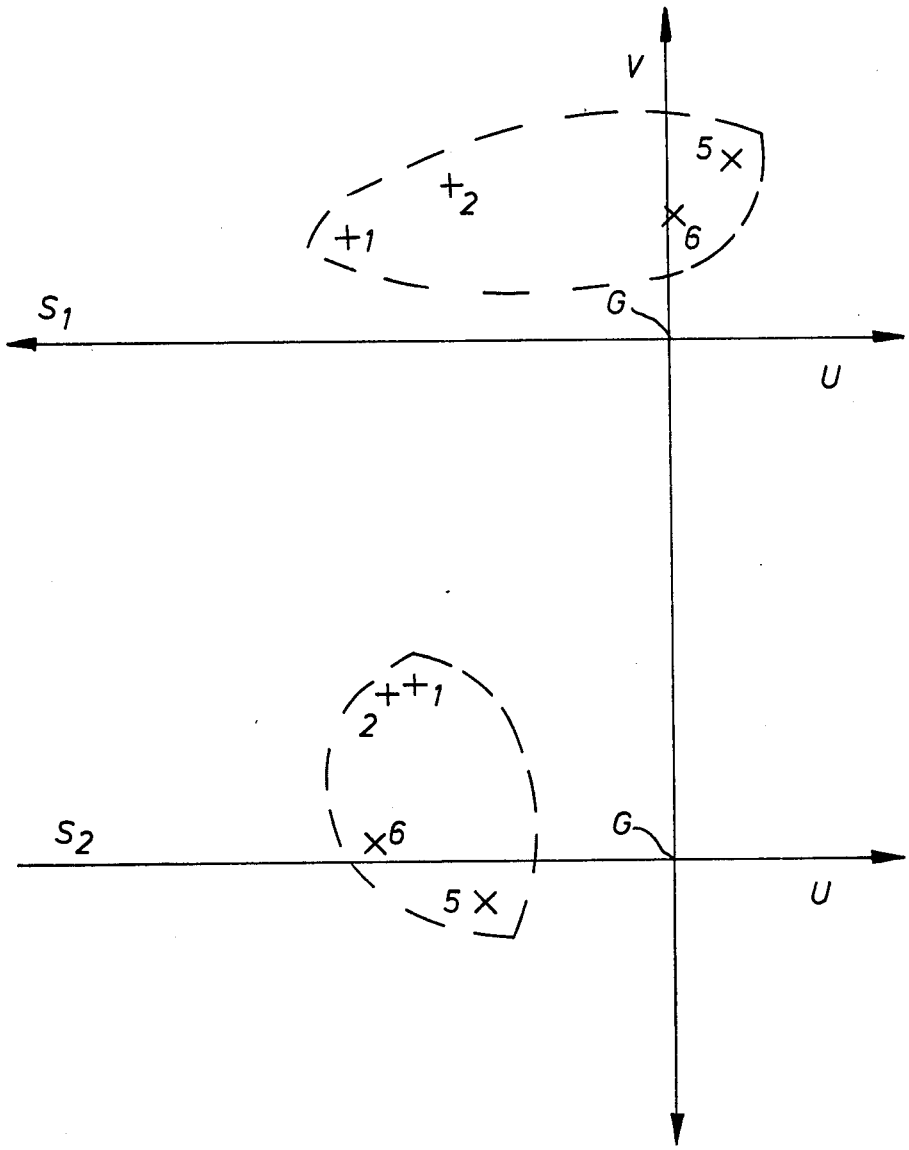
Figure 12:
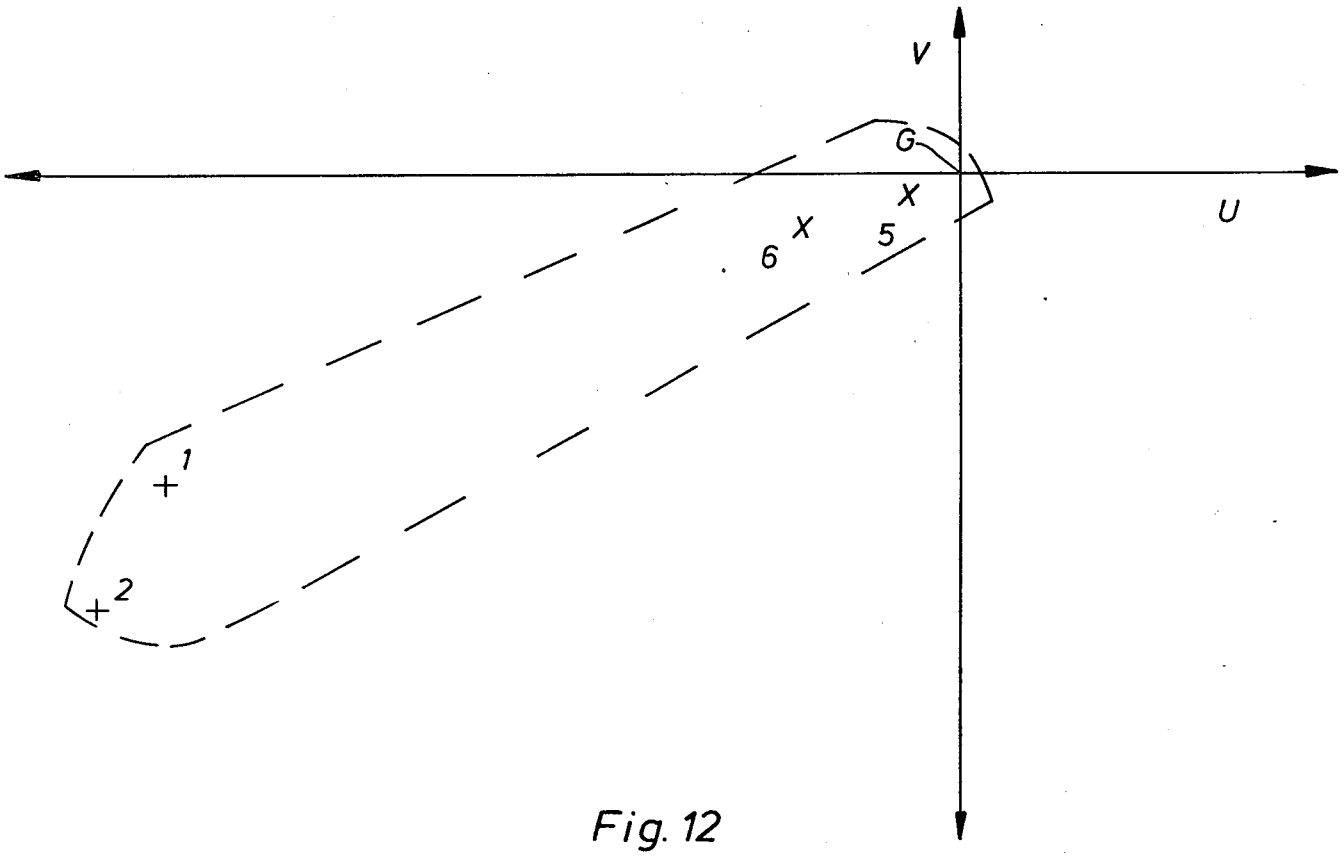

The example was repeated with a less "hard" recording material having a silver halide grain size distribution resulting in a lower average gradient, the average gradients of the red filter sensitometric curves being 1.13, 0.99 and 1.18 respectively, the average gradients of the green filter sensitometric curves being 1.06; 0.93 and 1.40 respectively and the average gradients of the blue filter sensitometric curves being 0.96; 0.82 and 1.32. The maximum density on the image-receiving materials A, B and C was 1.84, 1.70 and 1.70 respectively for the red, green and blue filter readings. FIGS. 11 ($S_1/S_2$) and 12 give the location of the colour points as defined for FIGS. 9 ($S_1/S_2$) and 10 respectively. From FIG. 12 (exposure without screen) and FIG. 11 relating to exposure with $S_1$ and $S_2$ screens as defined above the screen exposure effect on the colour point grouping can be learned. In FIGS. 11 and 12 the location of the colour points are represented on a same scale. Although the colour point spreading is reduced it is not reduced to the same degree as for the "hard" material. Moreover, the "softer" material yields with the screen exposure ($S_2$) an average gradient too low for acceptable tone rendition.

The red filter used in the densitometer was a Wratten filter Red No. 25.

The green filter used in the densitometer was a Wratten filter Green No. 58.

The blue filter used in the densitometer was a Wratten filter Blue No. 47.

The above Wratten filter Red No. 25 has a percent transmittance as represented on page E-218 of the Handbook of Chemistry and Physics, 52nd Edition, Editor Robert C. Weast—CRC Press 18901 Cranwood Parkway, Cleveland, Ohio 44128, U.S.A.

The above Wratten filter Green No. 58 has a percent transmittance as represented on page E-218 of said Handbook.

The above Wratten filter Blue No. 47 has a percent transmittance as represented also on page E-219 of said Handbook.

TABLE

Y.

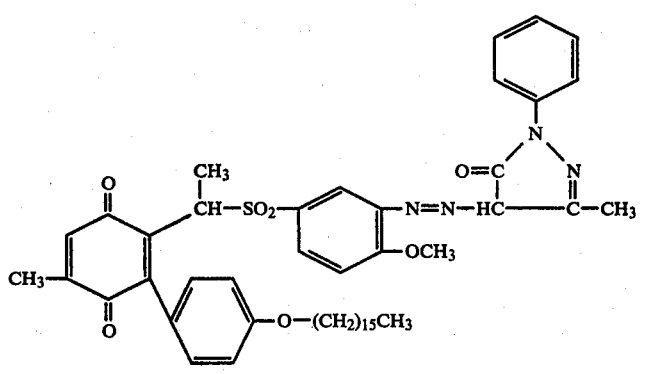

M.

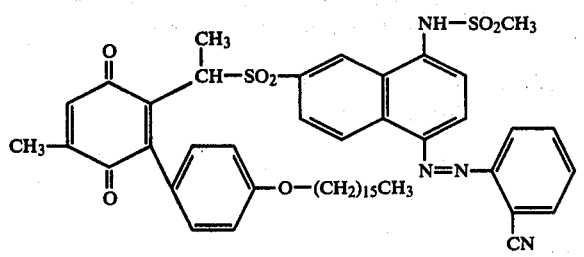

C.

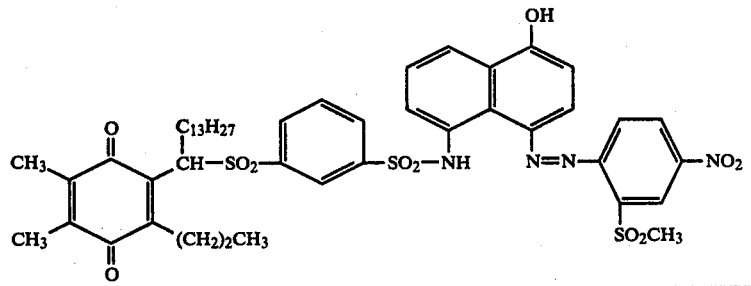

I claim:

1. A method of improving the colour balance of a multicolour reversal image obtained in a photographic material itself or obtained by a diffusion transfer reversal process in an image receiving material, said method comprising the steps of:

(1) providing a photographic silver halide material capable of yielding in said material or in an image receiving layer a multicolour reversal image, (2) image-wise exposing said photographic material to or through a multicolour continuous tone original while keeping in the optical path between the light source and the photographic material a light-distribution means dividing the light in line-like or dot-like portions over the exposed area of the photographic material, (3) developing and reversal-processing said photographic material, characterized in that the said material and said developing and processing are such that if the above image-wise exposure were to have been effected without said light-distribution means using a sensitometric grey wedge as original a reversal wedge print would be produced having blue filter (Wratten filter Blue No. 47), red filter (Wratten filter Red No. 25) and green filter (Wratten filter Green No. 58) sensitometric curves (optical density versus log exposure curves) having a maximum density of at least 1.4 and an average gradient of at least 1.8, said average gradient being the slope of the straight line joining the density point 0.2 above fog and the density point 0.2 below maximum density on the sensitometric curves of said wedge print, whereas because the image-wise exposure was effected through said light-distribution means as specified in step (2), blue filter, red filter and green filter sensitometric curves as defined above are obtained the average gradients of which are at most 1.50 but not lower than 1.00.

2. Method according to claim 1, characterized in that said average gradients of the reversal wedge print which would be produced with maximum density at least 1.4 using a sensitometric grey wedge as original without said light-distribution means is in the range of 2.0 to 3.5.

3. Method according to claim 1, characterized in that the values of the average gradients of the obtained sensitometric curves are between 1.0 and 1.2.

4. Method according to claim 1, characterized in that the light-distribution means is a contact screen.

5. Method according to claim 4, characterized in that the screen has a square-wave dot screen pattern.

6. Method according to claim 4, characterized in that the screen latitude is at least 1.5.

7. Method according to claim 4, characterized in that the screen period of the screen is in the range of 190 to 140 μm.

8. Method according to claim 1, characterized in that the light-distribution means is a contact screen kept during the exposure at a distance from the photographic material.

9. Method according to claim 1, characterized in that the exposure of the photographic material is carried out in contact with a contact screen the line or dot profiles of which are located between a transparent covering sheet and a transparent support of a different thickness in the order of 0.01 to 0.1 of a millimeter.

10. Method according to claim 1, characterized in that the original is a multicolour transparency.

11. Method according to claim 1, characterized in that the multicolour reversal image is produced by image-wise modulated diffusion transfer of dyes or dye providing compounds from an image-wise exposed and developed photographic silver halide emulsion material into an image-receiving layer.

12. Method according to claim 11, characterized in that a positive dye image is produced in said image receiving layer by a diffusible dye which is set free image-wise in diffusible state from a negative working silver halide emulsion material by reaction in alkaline conditions of an initially immobile image-dye providing compound with image-wise remaining non-oxidized developing agent.

13. Method according to claim 11, characterized in that the silver halide is silver chloride.

* * * * *